US007571493B1

(12) United States Patent
Purvis et al.

(10) Patent No.: US 7,571,493 B1
(45) Date of Patent: Aug. 11, 2009

(54) ARMORED GARMENT FOR PROTECTING

(75) Inventors: James W. Purvis, Albuquerque, NM (US); Jack F. Jones, II, Albuquerque, NM (US); Larry D. Whinery, Albuquerque, NM (US); Richard Brazfield, Albuquerque, NM (US); Catherine Lawrie, Tijeras, NM (US); David Lawrie, Tijeras, NM (US); Dale S. Preece, Watkins, CO (US)

(73) Assignee: Sandia Corporation, Albuquerque, NM (US)

( * ) Notice: Subject to any disclaimer, the term of this patent is extended or adjusted under 35 U.S.C. 154(b) by 530 days.

(21) Appl. No.: 11/197,245

(22) Filed: Aug. 4, 2005

Related U.S. Application Data

(60) Provisional application No. 60/598,968, filed on Aug. 4, 2004.

(51) Int. Cl.
*F41H 1/02* (2006.01)
*F41H 1/00* (2006.01)

(52) U.S. Cl. ..... 2/2.5

(58) Field of Classification Search ..... 2/2.5
See application file for complete search history.

(56) References Cited

U.S. PATENT DOCUMENTS 2,020,702 A * 11/1935 Samuel ..... 2/2.5
2,050,178 A * 8/1936 Hite ..... 2/2.5
2,748,391 A * 6/1956 Lewis, Jr. et al. ..... 2/2.5
2,755,475 A * 7/1956 Lipshitz ..... 2/2.5
2,862,208 A * 12/1958 Castro ..... 2/2.5
2,921,317 A * 1/1960 Tifft ..... 2/2.5
3,061,839 A * 11/1962 Foster ..... 2/2.5
3,331,083 A * 7/1967 Holly ..... 2/2.5
3,370,302 A * 2/1968 Karlyn ..... 2/2.5
3,398,406 A * 8/1968 Waterbury ..... 2/2.5
3,458,863 A * 8/1969 Lamber et al. ..... 2/2.5
3,902,196 A * 9/1975 Reinfandt ..... 2/2.5
3,991,421 A * 11/1976 Stratten ..... 2/2.5
4,195,362 A * 4/1980 Rolando ..... 2/461
4,356,569 A * 11/1982 Sullivan ..... 2/2.5
4,382,301 A * 5/1983 Hightower, Jr. ..... 2/22

(Continued)

OTHER PUBLICATIONS http://www.google.com/search?hl=en&rls=GGLH,GGLH:1969-53,GGLH:en&defl=en&q=define:gauntlet&sa=X &oi=glossary_definition&ct=title; google search term, "define gauntlet".*

(Continued)

*Primary Examiner*—Bobby H Muromoto, Jr.
(74) *Attorney, Agent, or Firm*—Robert D. Watson

(57) ABSTRACT

A lightweight, armored protective garment for protecting an arm or leg from blast superheated gases, blast overpressure shock, shrapnel, and spall from a explosive device, such as a Rocket Propelled Grenade (RPG) or a roadside Improvised Explosive Device (IED). The garment has a ballistic sleeve made of a ballistic fabric, such as an aramid fiber (e.g., KEVLAR®) cloth, that prevents thermal burns from the blast superheated gases, while providing some protection from fragments. Additionally, the garment has two or more rigid armor inserts that cover the upper and lower arm and protect against high-velocity projectiles, shrapnel and spall. The rigid inserts can be made of multiple plies of a carbon/epoxy composite laminate. The combination of 6 layers of KEVLAR® fabric and 28 plies of carbon/epoxy laminate inserts (with the inserts being sandwiched in-between the KEVLAR® layers), can meet the level IIIA fragmentation minimum $V_{50}$ requirements for the US Interceptor Outer Tactical Vest.

13 Claims, 15 Drawing Sheets

U.S. PATENT DOCUMENTS

| | | | | | |
|---|---|---|---|---|---|
| 4,425,667 | A | * | 1/1984 | Harrison | 2/462 |
| 4,453,271 | A | * | 6/1984 | Donzis | 2/456 |
| 4,467,476 | A | * | 8/1984 | Herbert | 2/2.5 |
| 4,497,069 | A | * | 2/1985 | Braunhut | 2/2.5 |
| 4,546,492 | A | * | 10/1985 | Dickenson | 2/46 |
| H000007 | H | * | 1/1986 | Martone | 2/2.5 |
| 4,732,803 | A | | 3/1988 | Smith, Jr. | |
| 4,783,853 | A | * | 11/1988 | Zuber | 2/456 |
| 5,044,011 | A | * | 9/1991 | Henderson | 2/2.5 |
| 5,060,314 | A | * | 10/1991 | Lewis | 2/2.5 |
| 5,095,544 | A | * | 3/1992 | Elverskog | 2/22 |
| 5,241,703 | A | * | 9/1993 | Roberts et al. | 2/2.5 |
| 5,511,241 | A | * | 4/1996 | Ziegler | 2/2.5 |
| 5,662,594 | A | * | 9/1997 | Rosenblatt | 602/16 |
| 5,729,832 | A | * | 3/1998 | Grilliot et al. | 2/23 |
| 5,876,834 | A | * | 3/1999 | Foy et al. | 428/192 |
| 5,911,197 | A | * | 6/1999 | Schmid | 119/712 |
| 5,966,747 | A | * | 10/1999 | Crupi et al. | 2/466 |
| 6,026,510 | A | * | 2/2000 | Kocher | 2/2.5 |
| 6,108,813 | A | * | 8/2000 | Tolliver et al. | 2/2.5 |
| 6,135,006 | A | * | 10/2000 | Strasser et al. | 89/36.05 |
| 6,240,565 | B1 | | 6/2001 | Spear | |
| 6,266,818 | B1 | * | 7/2001 | Howland et al. | 2/2.5 |
| 6,370,690 | B1 | | 4/2002 | Neal | |
| 6,401,427 | B1 | * | 6/2002 | Snyder | 52/764 |
| 6,543,055 | B2 | * | 4/2003 | Howland et al. | 2/2.5 |
| 6,548,430 | B1 | * | 4/2003 | Howland | 442/208 |
| 6,568,310 | B2 | | 5/2003 | Morgan | |
| 6,748,601 | B2 | | 6/2004 | LaShoto et al. | |
| 6,826,779 | B1 | | 12/2004 | McKenzie | |
| 6,846,758 | B2 | | 1/2005 | Bhatnagar et al. | |
| 6,892,392 | B2 | * | 5/2005 | Crye et al. | 2/2.5 |
| 6,912,944 | B2 | | 7/2005 | Lucuta et al. | |
| 7,266,850 | B1 | * | 9/2007 | Strum et al. | 2/2.5 |
| 7,363,846 | B1 | * | 4/2008 | Dean et al. | 89/36.05 |
| 2003/0066116 | A1 | * | 4/2003 | Graves et al. | 2/2.5 |
| 2004/0031079 | A1 | * | 2/2004 | Horvath et al. | 2/2.5 |
| 2005/0010987 | A1 | * | 1/2005 | Crye et al. | 2/2.5 |
| 2005/0108800 | A1 | * | 5/2005 | White | 2/2.5 |
| 2005/0170221 | A1 | * | 8/2005 | Kim et al. | 428/911 |
| 2006/0090233 | A1 | * | 5/2006 | Botcher | 2/2.5 |
| 2007/0016996 | A1 | * | 1/2007 | Seitzinger et al. | 2/2.5 |
| 2007/0028339 | A1 | * | 2/2007 | Carlson et al. | 2/2.5 |
| 2008/0087161 | A1 | * | 4/2008 | Dean et al. | 89/36.05 |
| 2008/0098500 | A1 | * | 5/2008 | Matic et al. | 2/2.5 |

OTHER PUBLICATIONS

"Ballistic Protection to Counter the . . . (IED) Threat", http://www.natick.army.mil/soldier/media/fact/individual/IED.Protection.htm , Dec. 12, 2004.

"Patrolling Route Irish", Albuquerque Journal, Section B8, Josh White, Dec. 19, 2004.

"Putting the 'ARM' in Body Armor", no author, http://www.military.com/soldiertech/0,14632,Soldiertech_Gauntlet,,00.html, Apr. 25, 2005.

"Cupola Protective Ensemble (CPE)", no author, http:/www.med-eng.com/sub.asp?id=296, Jul. 15, 2005.

"This armor could save your arms", Army Times, Jason Sherman and Deborah Funk, Jul. 12, 2004.

Interceptor body armor discussion forum remarks by "wattle1999", http://forums.military.com/groupee/forums/a/tpc/f/3101927042/m/93900743713, Jun. 7, 2005.

"G.I.'s Get Armor Add-Ons", http://www.defensetech.org/archives/001041.html, Jan. 1, 2005.

"Sandia's Arm-Saving Armor", FLC NewsLink, https://www.federallabs.org/newslink/nl200408_12.html, Aug. 26, 2004.

"CTC develops "Ballistic Gauntlet" lower-body armor protection device for warfighters", D.B. Eisenberg, http://www.ctc.com/index/cfm?fuseaction=1511&PR=05jun03b.htm, Jun. 3, 2005.

"Ballistic Gauntlet", http://www.ballisticgauntlet.com, Jun. 2005.

"Ballistic Gauntlet Fact Sheet", Scott Burk, Jun. 2005.

"Full body armour suit ready for trials in Iraq", http://www.military-quotes.com/forum/viewtopic.php?t=12229&start=0, Jun. 1, 2005.

"Bullet Proof Booties", The Dallas Morning News, by Richard Whittle, http://www.airforceots.com/portal/modules.php?name=News&file=article&sid=26, Apr. 20, 2005.

"Soldier/Cupola/Gunner Blast Protective Equipment", http://www.fbodaily.com/archive/2004/12-December/10-Dec-2004/FBO-00718612.htm, Dec. 10, 2004.

"Specialty fabrics find a home", R.G. Mansfield, http://www.textileworld.com/News.htm?CD=2673&ID=7963, Jul. 28, 2005.

"Body Armour Ideas", http://www.angelfire.com/art/enchanter/lorica.html, Jul. 19, 2005.

Composites on the frontlines, Sara Black, High-Performance Composites, Jan. 2005.

"Sandia created Kevlar gauntlets to protect soldies riding atop military vehicles in combat", Michael Padilla, Sandia Lab News, vol. 56, no. 14, Jul. 9, 2004.

"Army and Air Force to acquire Sandia Gauntlet body armor for field evaluation", Michael Padilla, Sandia Lab News, vol. 57, No. 4, Feb. 18, 2005.

Kevlar and Carbon Composite Body Armor Analysis and Testing, V. S. Berg et al., Proc. 2005 ASME Pressure Vessel and Piping Div. Conference, PVP2005-71433, Jul. 17-21, 2005.

"FSU Researchers Mold New Material to Protect Troops", Florida State University news release, www.fsu.com, Oct. 24, 2004.

"Soldier Extremity Protection Development", Fact Sheet, Florida Advanced Center for Composite Technologies, www.fac2t.eng.fsu.edu, Oct. 24, 2004.

* cited by examiner

ARMORED GARMENT FOR PROTECTING

CROSS-REFERENCE TO RELATED APPLICATIONS

This application claims the benefit of U.S. Provisional Patent Application Ser. No. 60/598,968, filed Aug. 4, 2004, which is incorporated herein by reference.

FEDERALLY SPONSORED RESEARCH

The United States Government has rights in this invention pursuant to Department of Energy Contract No. DE-AC04-94AL85000 with Sandia Corporation.

BACKGROUND OF THE INVENTION

This invention relates to personal body armor for protecting the human body from projectiles and from blast superheat, shrapnel, debris and molten metal spall from an explosive device. In this application, "garment" means an article of protective clothing that covers the entire length of the arm from wrist to shoulder in a continuous fashion, or, that covers the entire length of the leg from ankle to hip in a continuous fashion.

US Armed Forces service men and women are currently protected by the US Army Interceptor Outer Tactical Vest (OTV), which uses 28-30 layers of KEVLAR® ballistic fabric to protect against small arms fire and fragmentation. Optionally, front and back rigid armor inserts (Small Arms Protective Insert, SAPI) can be used to protect vital organs inside the chest from high velocity armor piercing bullets. The rigid armor SAPI plates are commonly made of thick ceramic (0.8-1 inches), hardened steel, or high-strength titanium alloy. The rigid plates cause the bullet to fragment, while the underlying ballistic fabric catches the fragments of bullet and ceramic pieces.

In Iraq and Afghanistan, US service members traveling in convoys are frequently attacked by Rocket Propelled Grenades (RPG's) and roadside Improvised Explosive Devices (IED's). Although they often live though the explosion because they are wearing the body armor vests, their exposed, unprotected arms are often severely mangled and must be amputated, usually above the elbow. In particular, service gunners manning the .50 caliber machine guns in the open-air cupolas of armored HUMVEE's and Bradley Fighting Vehicles are exposed to the blast effects of RPG's and IED's. Also, the drivers and passengers of trucks with the windows rolled down have exposed, vulnerable arms. The leg is also vulnerable if the truck doors are not armored.

When a RPG impacts the side of an armored vehicle, the explosion creates four main types of threat: (1) blast overpressure (i.e., shock wave), (2) blast superheated air and gases, (3) shrapnel, fragments, and debris from the device's casing, and (4) a spray of molten drops of liquid metal (spall) from the vehicle's steel. An armored protective arm or leg garment is needed to shield an exposed limb (arm or leg) against all four of these threats. However, it can't be too heavy or too rigid, because the gunner in a cupola must be able to move around and operate the machine gun without undue interference. If possible, an armored garment would weigh less than 10 pounds, and preferably closer to 5-6 pounds, to reduce fatigue on the arm muscles. Also, the gunner should be able to quickly remove the garment in an emergency, e.g., in less than 10 seconds. Additionally, soldiers who are on foot can be maimed or killed by roadside IED's; and would benefit from wearing armored arm or leg garments, in combination with an Interceptor armored body vest. An armored garment should also provide some level of protection against small arms fire and sniper rounds. Typically, the garment would be worn in combination with an Interceptor OTV body armor vest, preferably with rigid armor chest plate inserts.

Historically, armored sleeves for protecting the arm were used by Roman gladiators over 2000 years ago. The arm protection, also known as a "manica", consisted of overlapping horizontal bands of leather or curved sheet metal, held together by straps or rivets (see FIG. 1). Other types of ancient armor include chain mail, and one-piece sheet metal plates that covered from the upper arm, and another that covered the forearm. However, none of these ancient designs can withstand sniper bullets or the blast, heat, shrapnel and spall from modern-day explosive devices. It is only the relatively recent development of ballistic-resistant fabrics made of high-strength, synthetic fibers (glass, carbon/graphite, KEVLAR®, SPECTRA®, etc.), combined with advanced ceramic armor plates, that allows modern-day body armor vests and bomb disposal suits to successfully defeat these threats.

Bomb disposal suits do not currently employ rigid armor inserts in the arms because of the extra weight and reduced mobility. A typical suit already weighs 80-90 pounds, and the thick ceramic plates would add another 15-20 pounds to an already-overloaded person.

U.S. Pat. No. 6,108,813 to Tolliver et al. discloses a ballistic-resistant upper arm shoulder pad (epaulet) made of 30 layers of an aramid fiber (e.g., KEVLAR®) ballistic cloth, that covers the shoulder and upper arm. U.S. Pat. No. 5,060,314 to Lewis discloses a similar type of protective deltoid pad. However, neither patent teaches any type of protection for the elbow, lower arm, hand, or leg.

Armored protective pant legs or leg chaps are also needed to protect the legs against the same types of threats as described above.

Against this background, the present invention was developed.

SUMMARY OF THE INVENTION

A lightweight, armored protective garment for protecting an arm or leg from blast superheated gases, blast overpressure shock, shrapnel, and spall from a explosive device, such as a Rocket Propelled Grenade (RPG) or a roadside Improvised Explosive Device (IED). The garment has a ballistic sleeve made of a ballistic fabric, such as KEVLAR® cloth, that prevents thermal burns from the blast superheated gases, while providing some protection from fragments. Additionally, the garment has two or more rigid armor inserts that cover the upper and lower arm and protect against high-velocity projectiles, shrapnel and spall. The rigid inserts can be made of multiple plies of a carbon/epoxy composite laminate. The combination of 6 layers of KEVLAR® fabric and 28 plies of carbon/epoxy laminate inserts (with the inserts being sandwiched in between the KEVLAR® layers), can meet the level IIIA fragmentation minimum $V_{50}$ requirements for the US Interceptor Outer Tactical Vest.

BRIEF DESCRIPTION OF THE DRAWINGS

The accompanying drawings, which are incorporated in and form part of the specification, illustrate various examples of the present invention and, together with the detailed description, serve to explain the principles of the invention.

DETAILED DESCRIPTION OF THE INVENTION

The word "garment" traditionally means a glove with an extended cuff that covers the lower half of the forearm. In this application, however, "garmemt" means an shell or envelope that covers the entire length of the arm from wrist to shoulder in a continuous fashion, or that covers the entire length of the leg from ankle to hip in a continuous fashion. It can also extend past the wrist to cover the hands and fingers (or extend past the ankle to cover the feet and toes); as well as extending past the shoulder joint to cover the body in-between the shoulder joint and the neck. Additionally, as discussed later, the word "garment" is defined herein to also include protective, armored pant legs or leg chaps, covering the entire length of the leg from ankle to hip.

The phrase "rigid armor" typically means a plate of strong and tough material, such as a hardened steel, ceramic, high-strength titanium or aluminum alloy, etc. In this application, however, "rigid armor" also includes semi-rigid armor materials; such as the solid armor material called SPECTRA® Shield™, made of ultra-high strength SPECTRA® polyethylene fibers fused together under pressure and temperature into a semi-rigid, solid sheet or plate. The words "fabric" and "cloth" are used interchangeably herein. The phrase "ballistic fabric" means a ballistic-resistant fabric. The words "inserts" and "plates" are used interchangeably herein, although it is understood that the rigid armor inserts may be flat or curved plates; and may be curved in 1, 2, or 3-dimensions. The word "fibers" is meant to include filaments, ribbons, and strips. A yarn is a continuous strand comprised of many fibers or filament.

Figure 2:
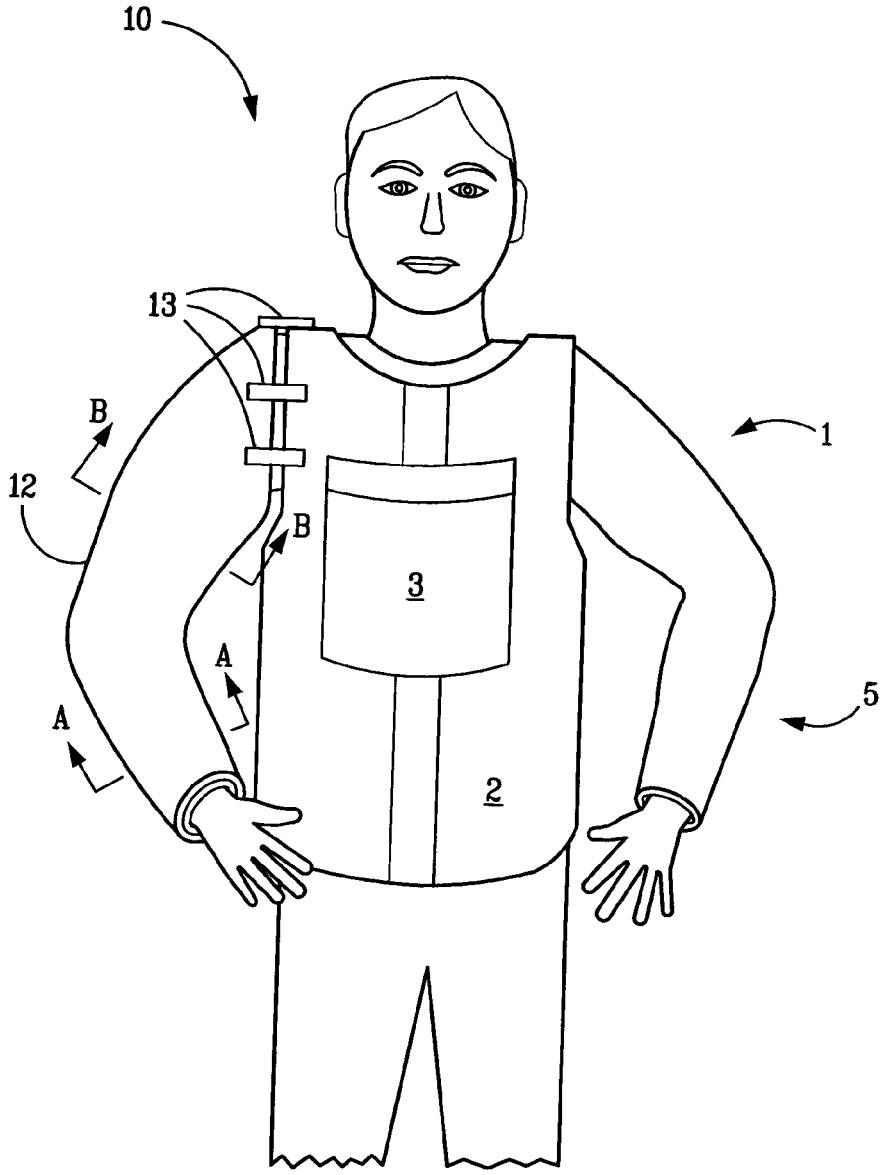
FIG. 2 shows a front, elevation view of a person wearing an armored protective garment, according to the present invention.

FIG. 2 shows a front, elevation view of a soldier wearing an armored protective garment, according to the present invention. Garment 10 comprises a ballistic sleeve 12 (i.e., shell or envelope) made of multiple layers of ballistic fabric. Sleeve 12 is a flexible tube that covers the entire length of the arm from wrist to shoulder in a continuous fashion. In one embodiment, the proximal (i.e., upper) end of sleeve 12 mates closely to the armhole in armored vest 2. The proximal end of sleeve 12 can be removably fastened to armored vest 2 by any well-known type of fastener, such as: hook-and-loop fasteners (e.g., VELCRO®), buttons, snaps, zipper, loops, overall's connectors, buckles, backpack-type quick-disconnect connectors, etc. Alternatively (not shown), sleeve 12 can be permanently attached to armor vest 2 by stitches, rivets, etc. However, it is not required to use an armored vest 2 in combination with garment 10.

Ballistic sleeve 12 can be made oversized, so that it will be able to easily fit over a soldier's uniform (including the rigid armor inserts). An oversized sleeve 12 can be easily and rapidly removed, in case of an emergency (for example, if the gunner has to quickly climb down from the cupola). In some embodiments, garment 10 can be worn without being attached to any other article of clothing (such as armored vest 2), which allows the garment to be removed in only a few seconds. Sleeve 12 can be tapered from a larger diameter at the proximal end (shoulder) to a smaller diameter at the distal end (wrist).

Ballistic sleeve 12 comprises multiple layers of tightly-woven, ballistic-resistant fabric or cloth, such as KEVLAR® ballistic fabric. Other types of high-strength, synthetic fibers may be used to make the ballistic fabric, including: glass fibers, carbon/graphite fibers, aramid fibers (e.g., KEVLAR®, TWARON®, TECHNORA®), para-aramid fibers, high and ultra-high molecular weight polyethylene fibers (e.g., SPECTRA®, DYNEEMA®). Ultra-high strength, steel filaments can also be woven into ballistic fabric.

High strength fibers useful in the yarns and fabrics of the invention include highly oriented high molecular weight polyolefin fibers, particularly polyethylene fibers, aramid fibers, polybenzazole fibers (e.g., ZYLON®) such as polybenzoxazole (PBO) and polybenzothiazole (PBT), polyvinyl alcohol fibers, polyacrylonitrile, liquid crystal copolyester, glass, carbon fibers or basalt or other mineral fibers, and combinations thereof.

In general, carbon/graphite fibers are the most expensive of all the synthetic fibers, especially the highest modulus carbon fibers.

Combinations of KEVLAR® and SPECTRA® fibers may co-woven together, as well as co-weaving micro-steel filaments. Many different weave patterns may be used, including, for example, a balanced weave, a satin weave, alternating 0/90 layers of unidirectionally-aligned fibers, and 3-D woven structures. The greater the number of layers, the greater the amount of protection from blast superheat and spall. However, the sleeve becomes less flexible with increasing numbers of layers. In fact, if the same number of layers that are used in the US Army Interceptor Outer Tactical Vest (28-30 layers of KEVLAR®, total thickness about 0.25 inches), were to be used in the garment's ballistic sleeve 12, it would be too stiff and almost unbendable. In one embodiment, a useful balance between flexibility and blast superheat/spall protection is a total of 4-8 layers of ballistic fabric. Various types of KEVLAR® fibers from DuPont, Inc. may be used, including KEVLAR® 29, KEVLAR® 49, and the most recent version, KEVLAR®® KM2.

Sleeve 12, which essentially is a tube or cylinder made of tightly-woven ballistic fabric, covers the entire circumference of the arm, since blast superheated gases and richocheting fragments or spall can impinge on the arm from any direction, including the inner part of the arm and underarm area.

Figure 3A:
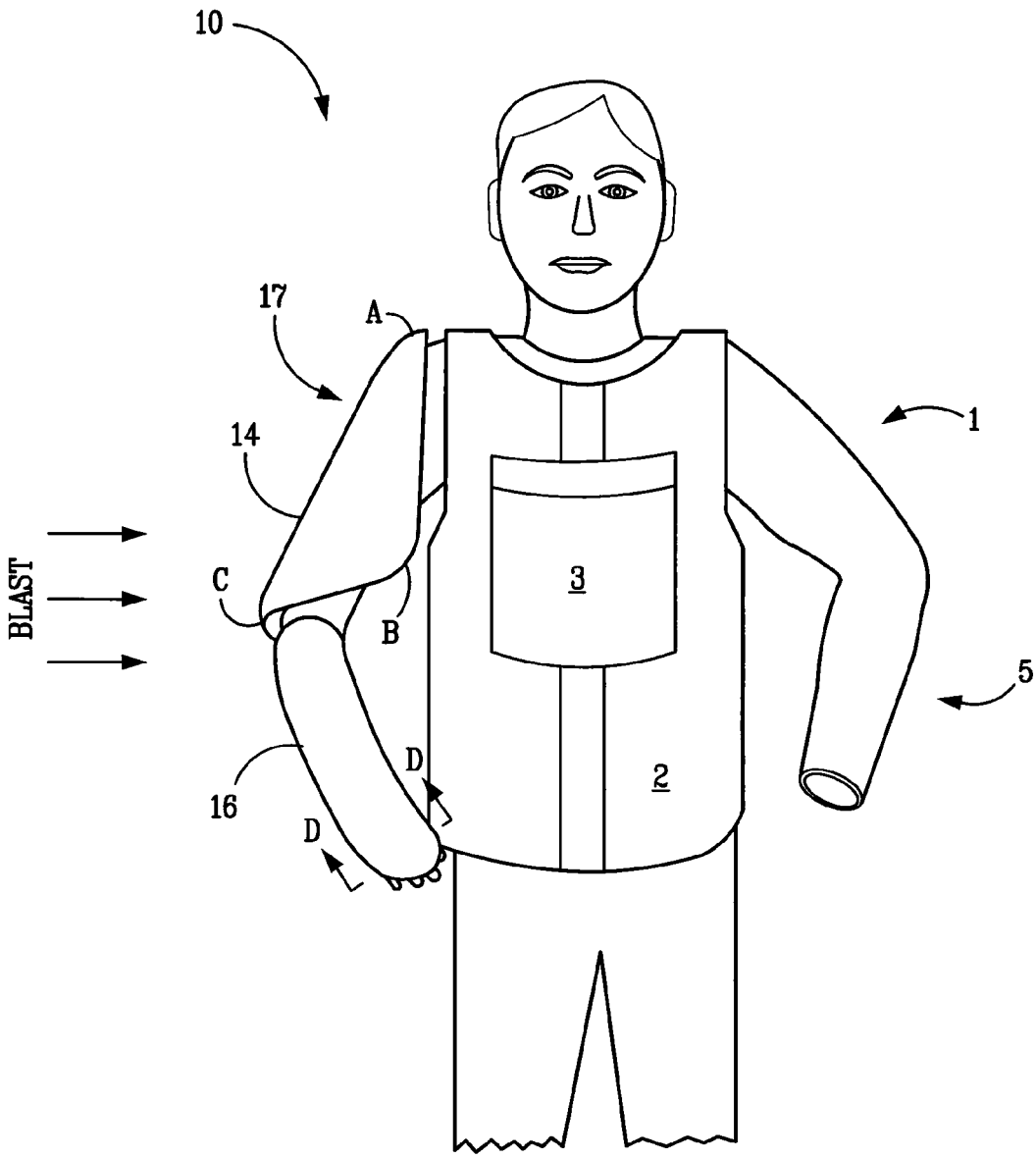
FIGS. 3A and 3B shows a front, elevation view of a person wearing an armored protective garment, with the sleeve removed for clarity, showing upper and lower arm rigid armor plates, according to the present invention.

In FIG. 3A, ballistic sleeve 12 has been removed to permit a pair of rigid armor inserts to be viewed. In this example, an upper rigid armor insert 14 covers the upper arm 1, and a lower rigid armor insert 16 covers the lower arm 5. The use of a pair of inserts 14 & 16, separated at the elbow, allows the arm to retain a useful range of motion and mobility. Armor plates 14 and 16 can be shaped or molded to closely fit or conform to the outer contours of the upper and lower arm segments, respectively, including the axillary region (under-arm).

Note that ballistic sleeve 12 can be worn by a soldier without using any of the rigid armor inserts. Although sleeve 12 comprises a relatively small number of layers of KEVLAR® fabric (e.g., 4-8 layers), and would not stop a 9 mm handgun round (this requires 28-30 layers of KEVLAR®); the sleeve without inserts would be more flexible, and would still protect the wearer against blast superheated gases and spall (and some small fragments). The weight of ballistic sleeve 12, comprising, for example, 6 layers of KEVLAR® fabric (without rigid inserts) is about 2 pounds.

Rigid armor inserts 14, 16 are made of special armor materials that can absorb the kinetic energy of high velocity projectiles and shrapnel without being substantially penetrated (see definition of V50 limit). Some examples of suitable rigid armor materials include hardened steel, ceramics, SiC fiber with SiC matrix composite, metal-ceramic composites, high-strength titanium or aluminum alloys, solid fused ultra-high strength SPECTRA® polyethylene fibers (SPECTRA® Shield™), and fiber-composite laminates. Any of the high-strength synthetic fibers can be woven into a cloth and impregnated with a matrix material, such as epoxy, then cured to make a fiber-composite laminate. The matrix material is typically resin that may be selected from the group consisting of thermoset allyls, aminos, cyanates, epoxies, phenolics, unsaturated polyesters, bismaleimides, rigid polyurethanes, silicones, vinyl esters, and their copolymers and blends. Preferably, the matrix comprises an epoxy-based vinyl ester resin. A single layer, or ply, can be pre-impregnated with the wet matrix resign, and stored in this condition (at cold temperatures). Single sheets of this "pre-preg" material can then be stacked to make a thick plate or sheet, and heated under pressure to cure the epoxy resin and bond the individual plies together into a monolithic body. The number of layers can range from, for example, 15-30 plies, and the thicknesses of the cured laminate can range from 0.2-0.5 inch (although, in principle, there is no real limit to the minimum or maximum number of plies, or the minimum or maximum thickness of a cured laminate).

As can be seen in FIG. 3A, rigid armor inserts 14, 16 can be highly curved and custom shaped or molded to fit the outer shape of the arm. These complex shapes can be easily fabricated using fiber-reinforced composites, because each ply of woven fabric or "pre-preg" is very flexible and can be easily laid up in a rigid mold that defines the curved surfaces. Making a highly curved armor plate would be difficult, if not impossible, to accomplish using ceramics, such as boron carbide, or hardened steel or high-strength titanium or aluminum alloys.

In one embodiment, rigid armor inserts 14, 16 can be made of carbon/epoxy laminates (also described as carbon composites). This is an attractive material system (i.e., carbon pre-preg), because it is commonly used by large Industries, such as aircraft, boating, etc. and is relatively available. Carbon/composite pre-preg, however, must be kept cold before being laid up to prevent premature curing at room temperature. The number of plies can range, for example, from 18-28 plies, depending on the level of protection required. Generally, thicker armor plates withstand higher velocity projectiles than thinner plates. Specifically, inserts 14, 16 may comprise AS-4 carbon fiber cloth, satin weave, pre-impregnated with epoxy. With 18 plies of carbon fiber cloth, the carbon/epoxy laminate's final cured thickness is about 0.27 inches, and the weight of each rigid insert plate is about 1.2-1.3 pounds. With 28 plies of carbon fiber cloth, the carbon/epoxy laminate's final cured thickness is about 0.42 inches, and the weight of each rigid insert plate is about 1.9-2.0 pounds.

The total weight of garment 10 comprising a pair of carbon/composite rigid armor inserts and a KEVLAR® ballistic sleeve ranges from about 4.5 to 5.9 pounds, for the 18 ply and 28 ply carbon/composite inserts, respectively. This is considerably lighter than the US Army Interceptor Outer Tactical Vest with ceramic ballistic plate inserts front and back, where the Vest+Inserts weighs a total of 16.4 pounds.

Figure 3B:
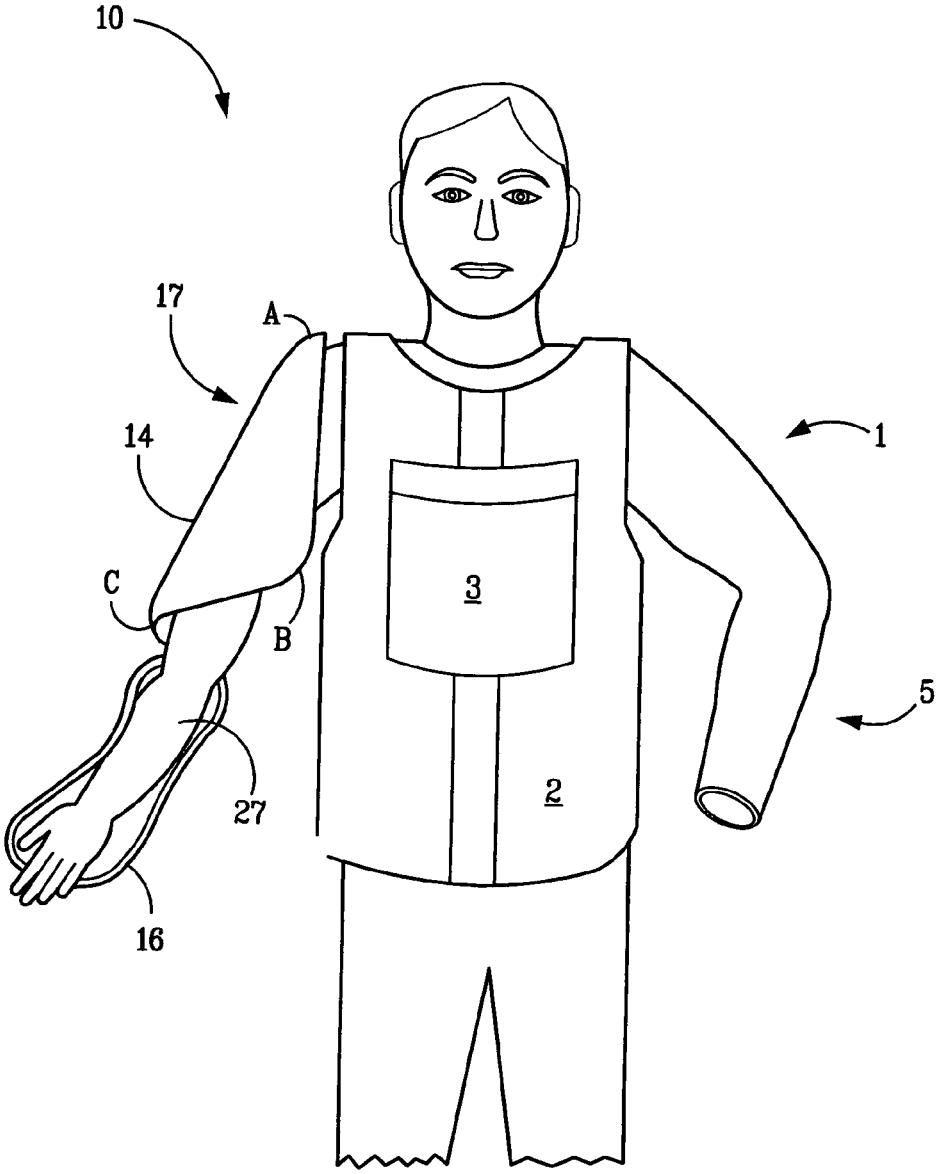

FIG. 3B shows essentially the same example of a pair of rigid armor plates 14, 16 as shown in FIG. 3A, except that the lower arm has been rotated to the "palms up" position (as opposed to FIG. 3A, which shows the lower arm in the "palms down" position). In the palms-up position of FIG. 3B, it can be seen that lower insert 16 does not cover the palm of the hand, or the underside surface 27 of the lower arm.

Figure 4:
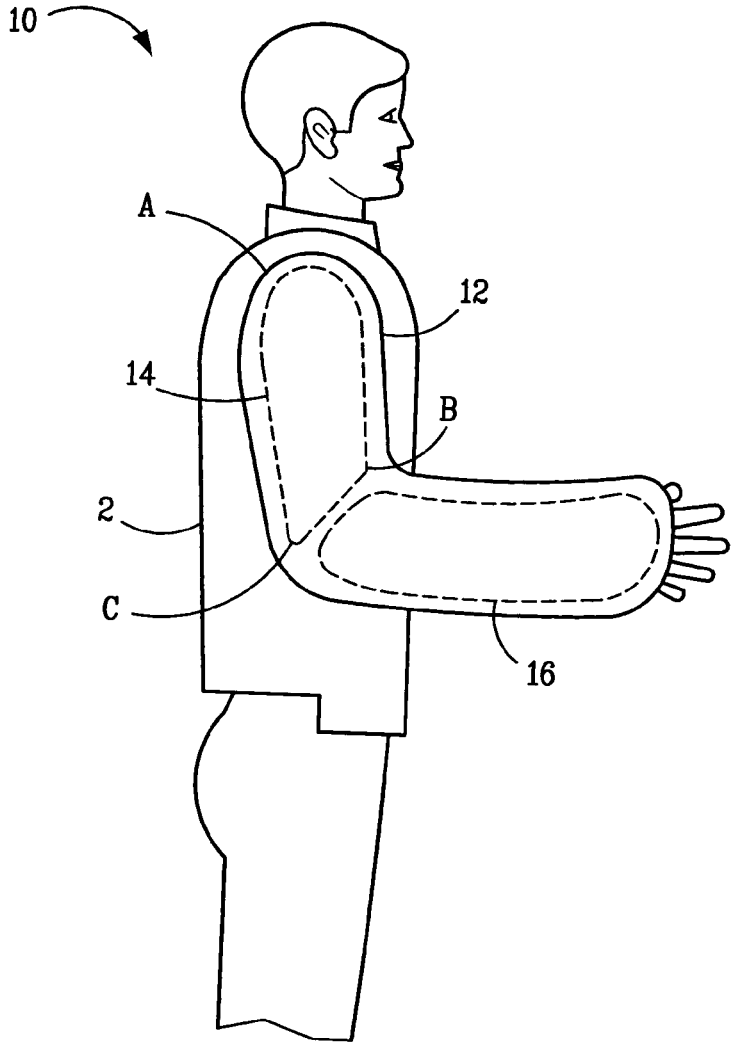
FIG. 4 shows a side, cutaway, elevation view of a person wearing an armored protective garment, according to the present invention.

FIG. 4 shows a side, cutaway, elevation view of a person wearing an armored protective garment according to the present invention. Garment 10 comprises an upper rigid armor insert 14 and a lower rigid armor insert 16, held inside of a protective ballistic sleeve 12. Here, the sleeve has been cut-away to show the armor plates 14, 16 inside. In this example, the two plates don't overlap each other, but, rather, butt up against each other. The distal end of the lower insert 16 covers the hand up to the knuckles. But, in other embodiments, the distal end of lower insert 16 may be cut-off at the wrist to provide a greater range of motion for the hand, at the expense of having no protection for the hand.

Figure 5A:
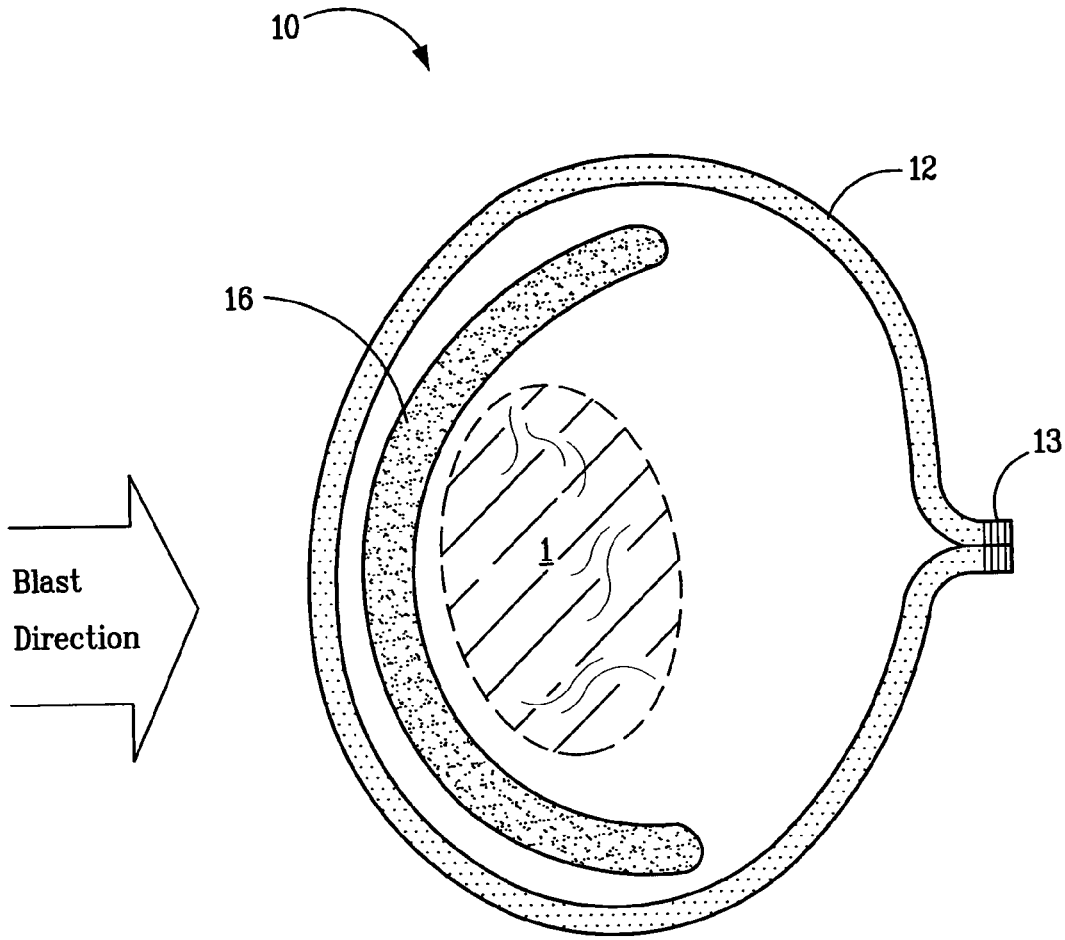
FIG. 5A shows a cross-section end view at Sec. A-A from FIG. 2, of an armored protective garment, according to the present invention.

FIG. 5A shows a cross-section end view at Sec. A-A of the lower arm from FIG. 2, of an armored protective garment, according to the present invention. Garment 10 comprises a ballistic sleeve 12 completely encircling the arm 1, and a rigid lower armor insert 16 disposed in-between the sleeve 12 and arm 1. Rigid insert 16 has a C-shaped cross-sectional shape, and is molded to fit the outer-contour of the arm (in this example, the lower arm). Rigid armor insert 16 covers the outside-facing surface of the arm, since this is the likely direction that blast shrapnel or high-velocity bullets will come from. In this example, only about one-half of the arm's outer surface is wrapped with rigid armor 16. By not exceeding a wrap-angle by more than 180 degrees, the fabrication is generally simpler and cheaper. The long, stitched seam or hem 13, which runs along the length of sleeve 12, may be located on the side opposite from the rigid insert 16 (i.e., opposite from the side exposed to the blast). Alternatively, seam 13 can be replaced with a heavy-duty zipper, or a long strip of hook-and-loop fastener (e.g., VELCRO®), to permit the sleeve to be un-zipped and folded open. Use of VELCRO® fasteners for seam 13 would allow the wearer to adjust the tightness or looseness of the garment, depending on the arm size and on the amount of clothing worn underneath. Optionally, rigid insert 16 may be glued to the inside of sleeve 12.

Figure 5B:
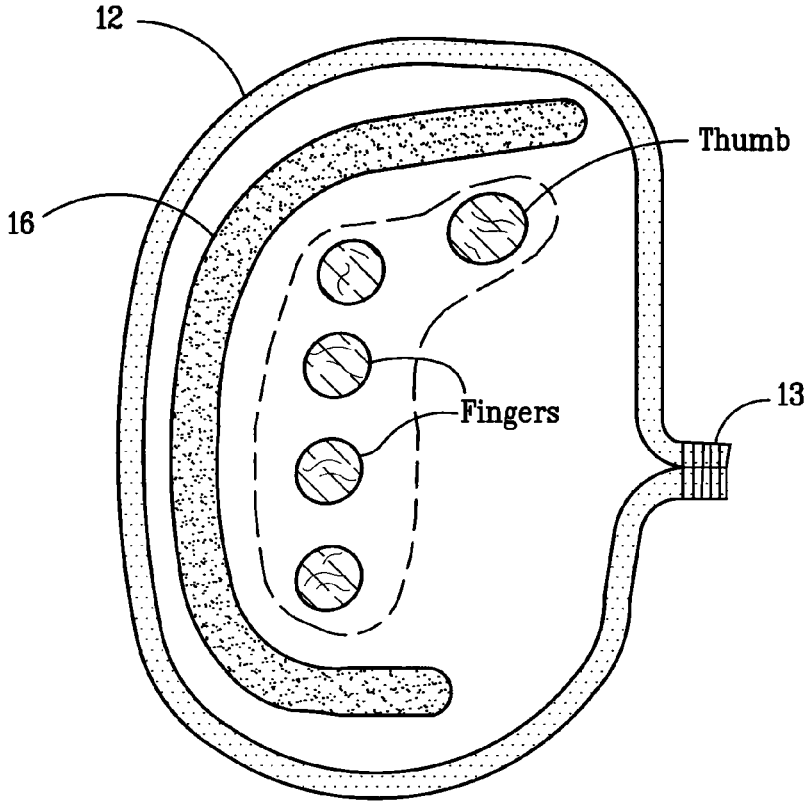
FIG. 5B shows a cross-section end view at Sec. D-D from FIG. 2, of an armored protective garment, according to the present invention.

FIG. 5B shows a cross-section end view at Sec. D-D of the lower arm from FIG. 2, of an armored protective garment, according to the present invention. At this location, the cross-section cuts through the fingers and thumb of the hand. The shape of rigid insert 16 is quite different than the shape show at the mid-forearm location in FIG. 5A (i.e., Sec. A-A). In Sec. D-D, the rigid insert 16 has an over-hanging part that covers the top of the thumb, and the entire cross-section is more of a closed "C" shape than the more open "C"-shape in FIG. 5A at sec. A-A. Such a complicated change in shape and curvatures can be readily accommodated by using fiber-reinforced composite layups, such as C/epoxy prepreg laid up in a mold.

Figure 6:
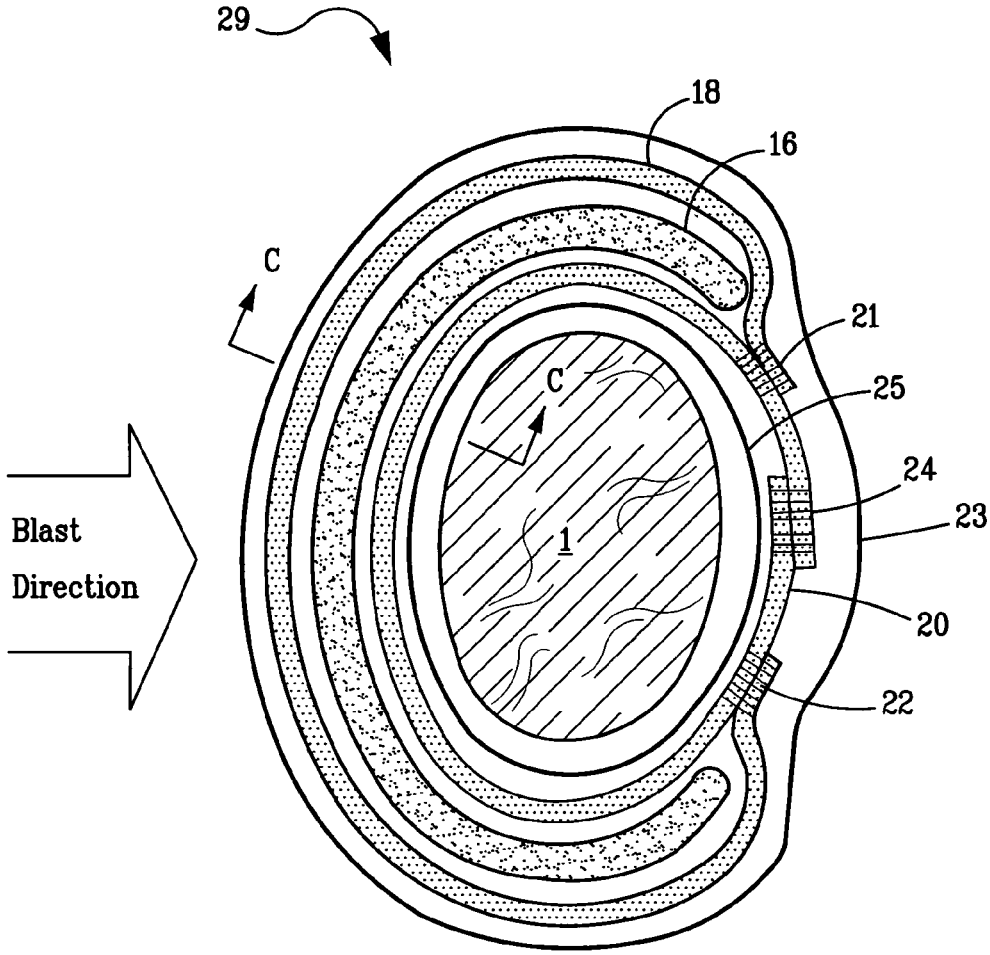
FIG. 6 shows a cross-section end view, Sec. B-B of the upper arm from FIG. 2, according to the present invention.

FIG. 6 shows a cross-section end view, Sec. B-B of the upper arm region from FIG. 2, according to the present invention. Garment 20 comprises a outer ballistic sleeve 18, an inner ballistic sleeve 20, and upper rigid armor insert 14 sandwiched in-between the outer and inner ballistic sleeves, 18 & 20, respectively. Rigid insert 14 has a more-dramatic C-shaped cross-sectional shape, and is molded to fit most of the outer-contour of the upper arm. In this example, rigid armor 14 wraps around most (about 260 degrees) of the circumference of the upper arm, thereby providing more protective coverage than the 180 degree coverage C-shaped cross-section shown previously in FIG. 5 for the lower arm. However, the greater coverage of insert 14 in FIG. 6 is more expensive to fabricate. The inner sleeve 20 is stitched to the outer sleeve 18 at two locations, seam 21 and seam 22, thereby forming an interior pocket that securely holds upper armor insert 14. The interior pocket can be open at the upper end of the pocket to facilitate easy removal of the insert (with a VELCRO® closure, for example); or, the pocket can be completely stitched shut to permanently house the insert. The long seam 24 in the outer sleeve 18 can be an overlapping stitched seam.

Outer cover 23 comprises a thin layer of a non-ballistic cloth, for keeping the outer ballistic sleeve 18 clean, for providing a wear surface, etc. Outer cover 23 may be made of nylon cloth, ripstop nylon cloth, CORDURA® nylon, cotton fabric, NOMEX® fabric, etc., and may have a camoflage pattern. Outer cover 23 may optionally comprise a waterproof rain layer, such as GORE-TEX®. Outer cover 23 may be removable and separable from the outer ballistic sleeve 18 to facilitate easy washing of the cover 23; as well as to facilitate visual inspection of the outer ballistic fabric for damage, etc.

Inner liner 25 comprises a thin layer of a non-ballistic cloth, for keeping the inner ballistic sleeve 20 clean, for providing a comfort surface, etc. Inner liner 25 may be made of nylon cloth, ripstop nylon cloth, CORDURA® nylon, cotton fabric, NOMEX®, etc. Inner liner 25 may be removable and separable from the inner ballistic sleeve 20 to facilitate easy washing of the liner 25; as well as to enable visual inspection of the inner ballistic sleeve for damage, etc.

Referring still to FIG. 6, the outer and inner ballistic sleeves, 18 & 20, comprise multiple layers of a ballistic fabric, such as KEVLAR® cloth. The primary function of the outer ballistic sleeve 18 is to protect against blast superheated gases and spall. The primary function of the inner ballistic sleeve 20 is to catch any fragments of metal or parts of the rigid armor insert 16, which may have penetrated past the rigid armor insert 14. In some embodiments, the total number of layers of KEVLAR® fabric (including both the inner and outer sleeves 18, 20), may range from 4-8 layers. In one embodiment, the outer sleeve 18 comprises 6 layers of KEVLAR® cloth, and the inner sleeve 20 comprises 2 layers of KEVLAR® cloth. In another embodiment, the outer sleeve 18 comprises 4 layers of KEVLAR® cloth, and the inner sleeve 20 comprises 4 layers of KEVLAR® cloth. In another embodiment, the outer sleeve 18 comprises 4 layers of KEVLAR® cloth, and the inner sleeve 20 comprises 2 layers of KEVLAR® cloth. In another embodiment, the outer sleeve 18 comprises 2 layers of KEVLAR® cloth, and the inner sleeve 20 comprises 4 layers of KEVLAR® cloth.

By way of comparison, the current version of the US Army body armor vest ("Interceptor" Outer Tactical Vest) comprises 28-30 layers of soft KEVLAR® fabric, which protects against 9 mm handgun bullets and fragmentation. The Interceptor vest also has front and rear pockets for holding optional rigid armor plates made of boron carbide ceramic backed by SPECTRA® Shield, which provide additional protection against high-velocity projectiles.

Figure 7:
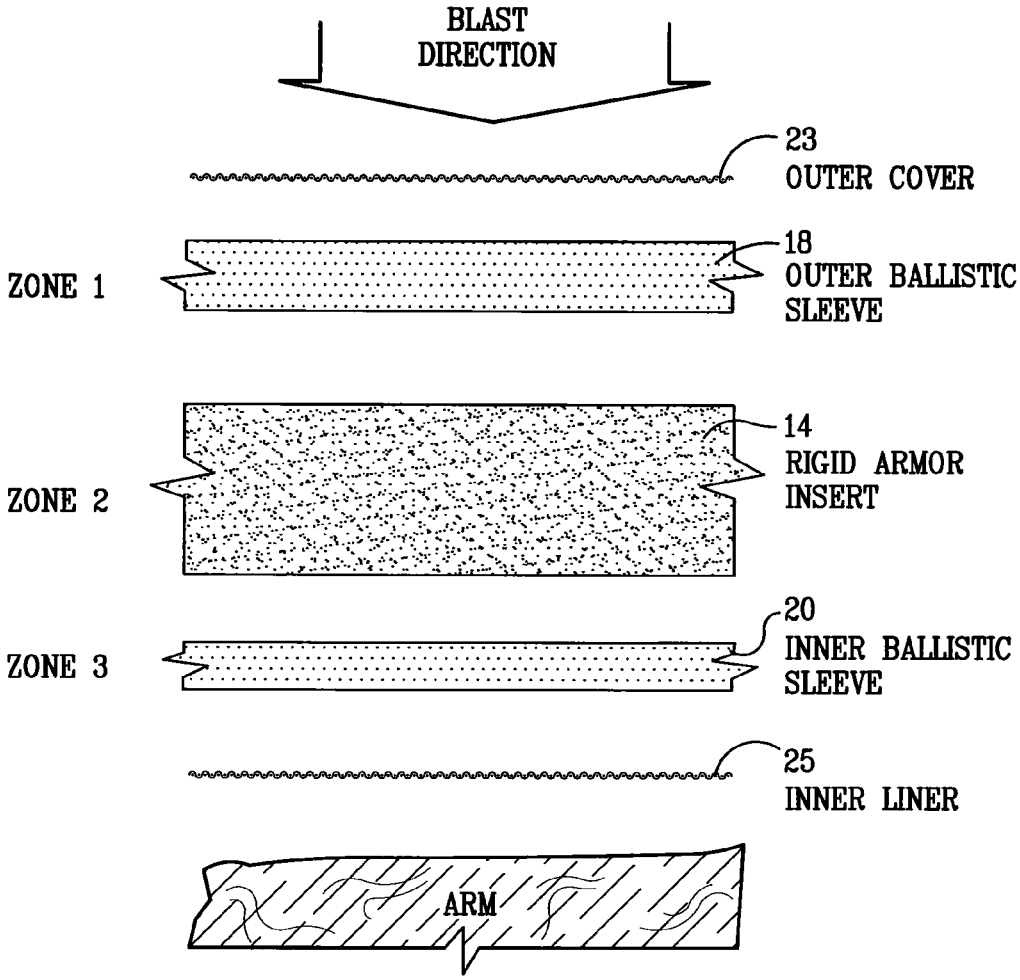
FIG. 7 shows a cross-section view, Sec. C-C, through the wall of the armored protective garment of FIG. 6, on the armored side facing the blast direction, according to the present Invention.

FIG. 7 shows a cross-section view, Sec. C-C, through the wall of the armored protective garment of FIG. 6 on the armored side facing the blast direction, according to the present invention. FIG. 7 illustrates the multi-zone construction of the protective armor system. Outer cover 23, made of nylon or cotton, covers the outer ballistic sleeve, 18, which comprises 4 layers of KEVLAR® fabric. Next is the rigid armor insert, 14, which comprises 28 plies of carbon fiber/epoxy composite laminate. Next is the inner ballistic sleeve, 20, which comprises 2 layers of KEVLAR® fabric. Finally, an inner liner, 25, is disposed in-between the arm and the inner sleeve 20. None of the individual layers, 23, 18, 14, 20, and 25, are required to be bonded together by a glue or adhesive. This allows the insert 28 to be removed and replaced, if necessary. The other layers of "fabrics" (23, 18, 20, 25) are stitched together (or heat-bonded) at the appropriate boundaries to form the continuous garment article of clothing. Nevertheless, another option is to glue the various sets or zones of materials together.

Figure 8:
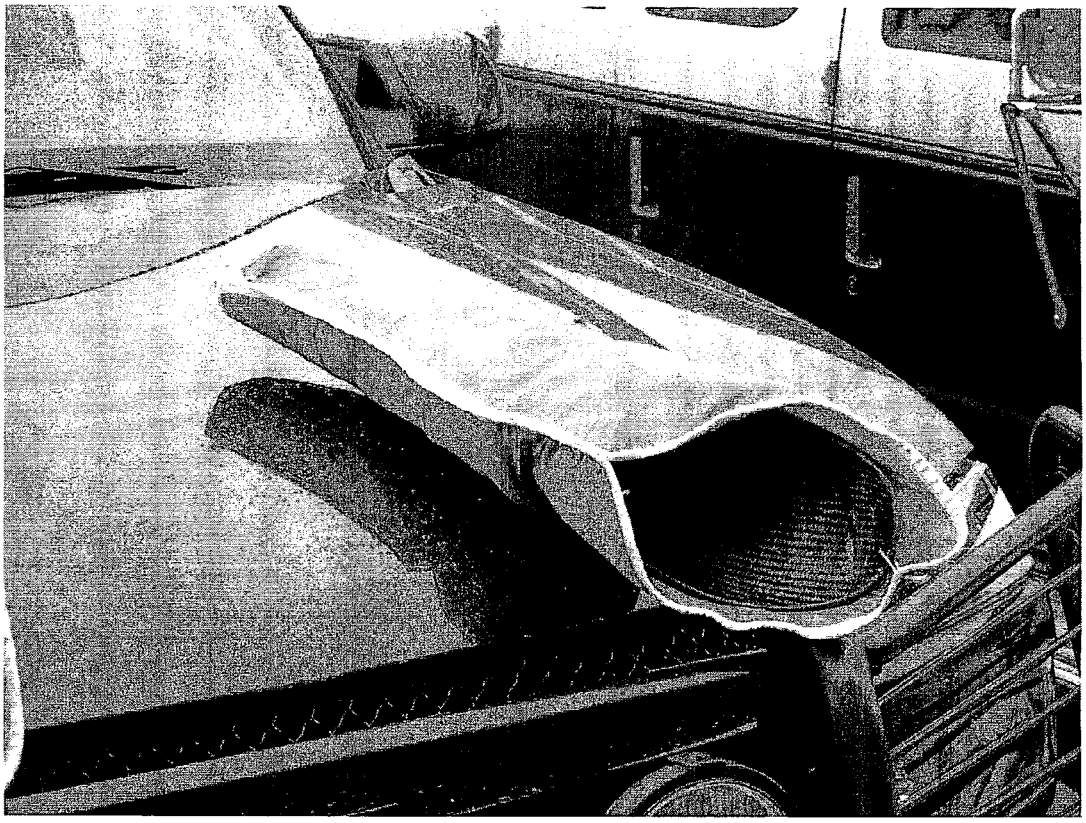
FIG. 8 is a photograph of the first prototype of an armored protective garment, looking into the upper armhole of the garment, according to the present invention.

FIG. 8 is a photograph of the first prototype of an armored protective garment, looking into the upper armhole of the garment, according to the present invention. This early version of a garment 10 was made according to the design shown in FIG. 5, where there is no inner ballistic sleeve.

Figure 9:
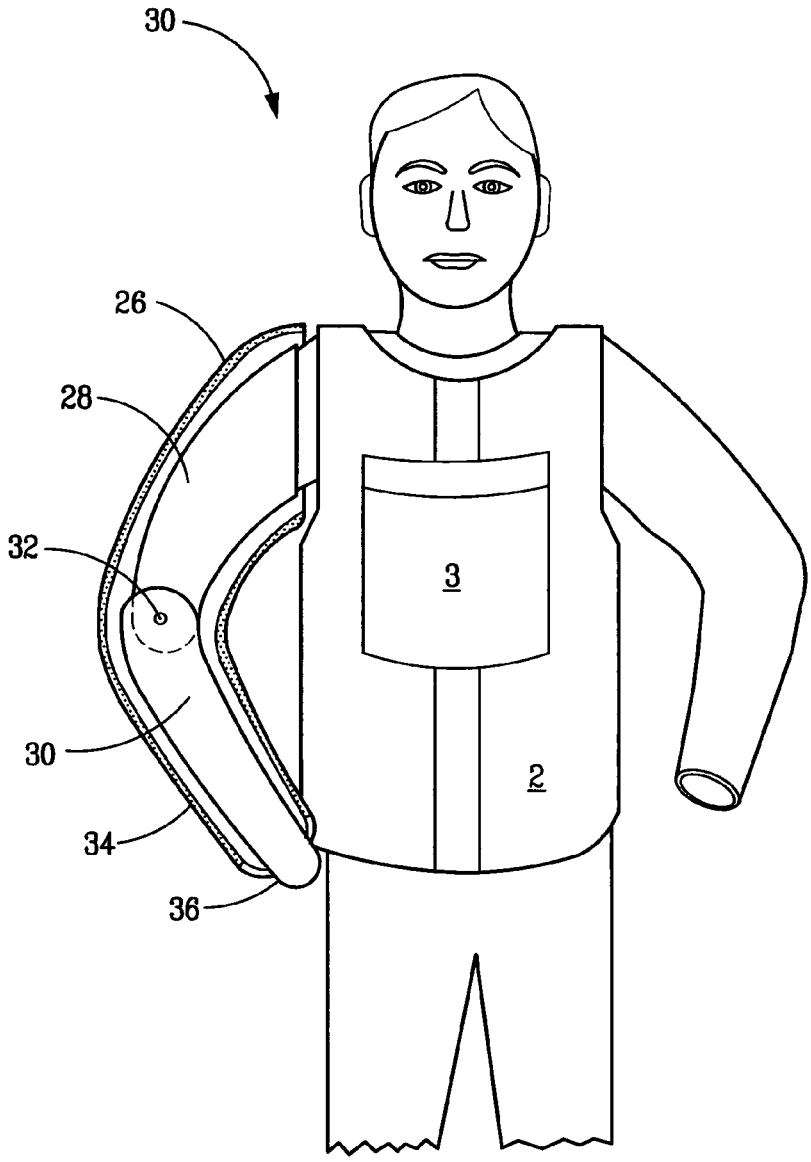
FIG. 9 shows a front, elevation view of a person wearing an armored protective garment, with the sleeve cut away for clarity, showing upper and lower arm rigid armor plates that are overlapped and pinned together at the elbow, according to the present invention.

FIG. 9 shows a front, elevation view of a person wearing an armored protective garment 30, with the sleeve 26 cut-away for clarity, showing upper 28 and lower 30 arm rigid armor plates that overlap and are pinned 32 together at the elbow. This embodiment provides increased coverage of the elbow joint. FIG. 9 also shows an embodiment where the distal end of lower arm insert 30 extends a few inches past the distal end 34 of sleeve 26 (which ends at the wrist), thereby providing armor protection for the hand and fingers, without interference of the hand's mobility by the KEVLAR® sleeve.

Figure 10A:
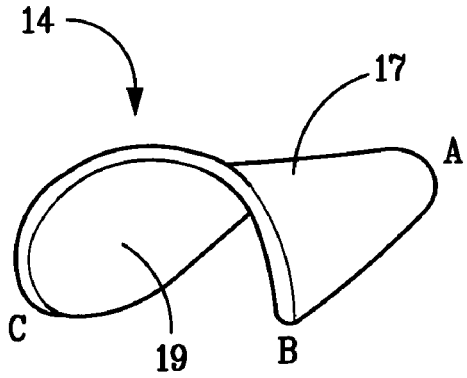
FIGS. 10A-D show isometric views of an upper arm rigid armor Insert, shown from a variety of different viewpoint angles.
Figure 10C:
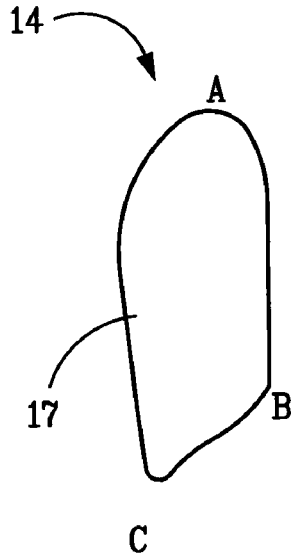
Figure 10B:
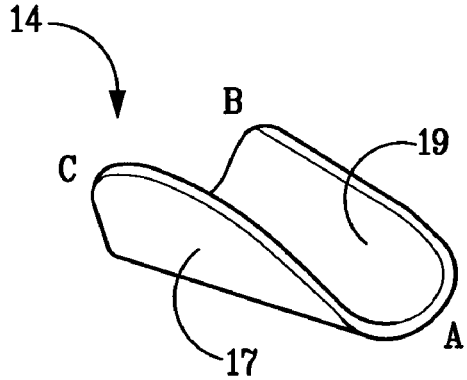
Figure 10D:
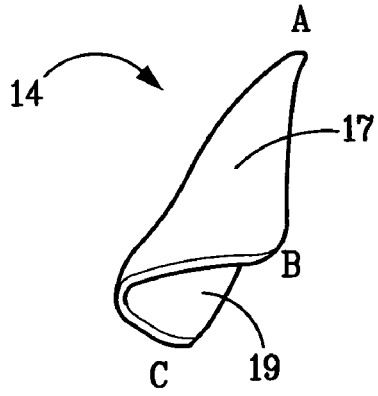

FIGS. 10A-D show isometric views of an upper arm rigid armor insert 14, shown from a variety of different viewpoint angles. Insert 14 is a shell structure with complex, compound curved surface contours. Surface 17 is the surface facing outwards that is exposed to the blast, etc. Surface 19 is the interior surface facing the arm. Due to the complex 3-D curved surface, landmark points A, B, and C have been designated to help the viewer understand the orientation. FIG. 10C shows the insert oriented in it's proper position on the upper arm, as viewed looking at the side of the soldier. FIG. 10D shows the insert oriented in it's functional position on the upper arm, as viewed looking at the front of the soldier. A prototype of this insert was actually fabricated with 18 plies of AS-4 carbon fiber/epoxy pre-preg, and laminated and cured into a rigid shell. The longest dimension of the prototype is about 14 inches, its width is about 5.5 inches, and its thickness is about 0.3 inches. The complex shape of upper insert 14 was designed so as to cover as much of the upper arm as possible, including the back side of the upper arm, the shoulder joint, the bicep region; while retaining a large degree of upper arm mobility, and without interfering with the elbow's motion.

Rigid armor inserts 14 and 16 can be described as a "shell" structure, rather than a "plate"; partly because of the complex, compound 3-D curvature, and partly because the structure is rather thin, compared to its typical length and width dimensions.

Note that the rigid armor inserts 14, 16 shown in FIGS. 3 and 4, are illustrated as being custom-fit to the right arm. Hence, a mirror opposite set would be used for the left arm. However, in other embodiments, the rigid armor inserts may comprise a "universal", cylindrically symmetric shape that can be used interchangeably for either the right or left arm.

Figure 11:
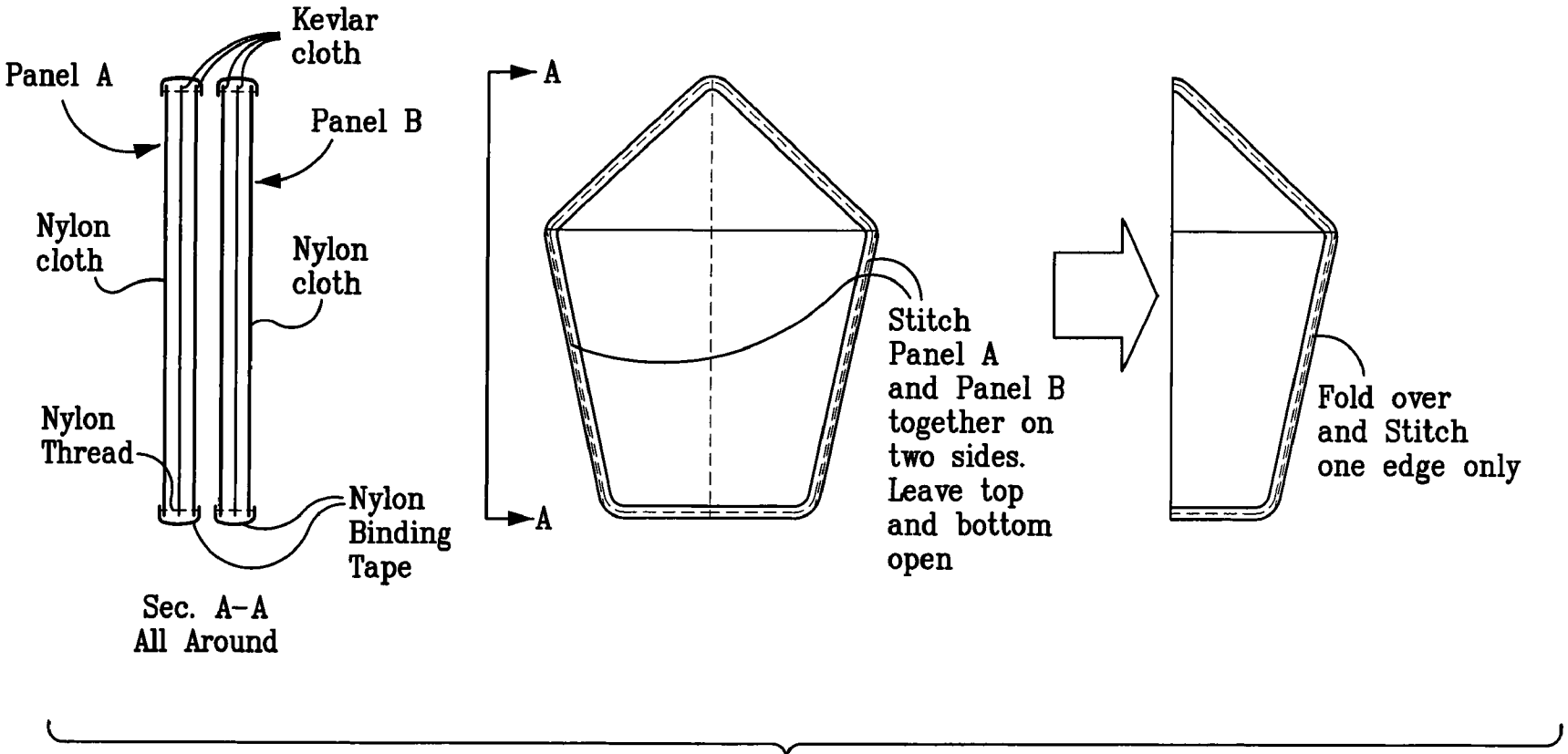
FIG. 11 shows an example of a pattern layout and stitching instructions for sewing up a ballistic sleeve for an armored protective garment, according to the present invention.

FIG. 11 shows an example of a pattern layout and stitching instructions for sewing up a ballistic sleeve for an armored protective garment, according to the present invention.

It is expected that a pair of armored garment could be manufactured for about $200-300 per garment.

Certain embodiments of the present invention also comprise a multi-zone armor system, comprising a first zone comprising 2-6 layers of a flexible ballistic fabric; a second zone comprising a rigid plate comprising at least 15 plies of a carbon/epoxy composite laminate; and a third zone comprising 2-6 layers of the flexible ballistic fabric; wherein the second zone is located in-between the first and third zones; and wherein the three zones do not need to be bonded together. The flexible ballistic fabric can be KEVLAR® fabric; and the rigid armor plate can comprise 18 to 28 plies of the carbon/epoxy composite laminate.

Figure 1:
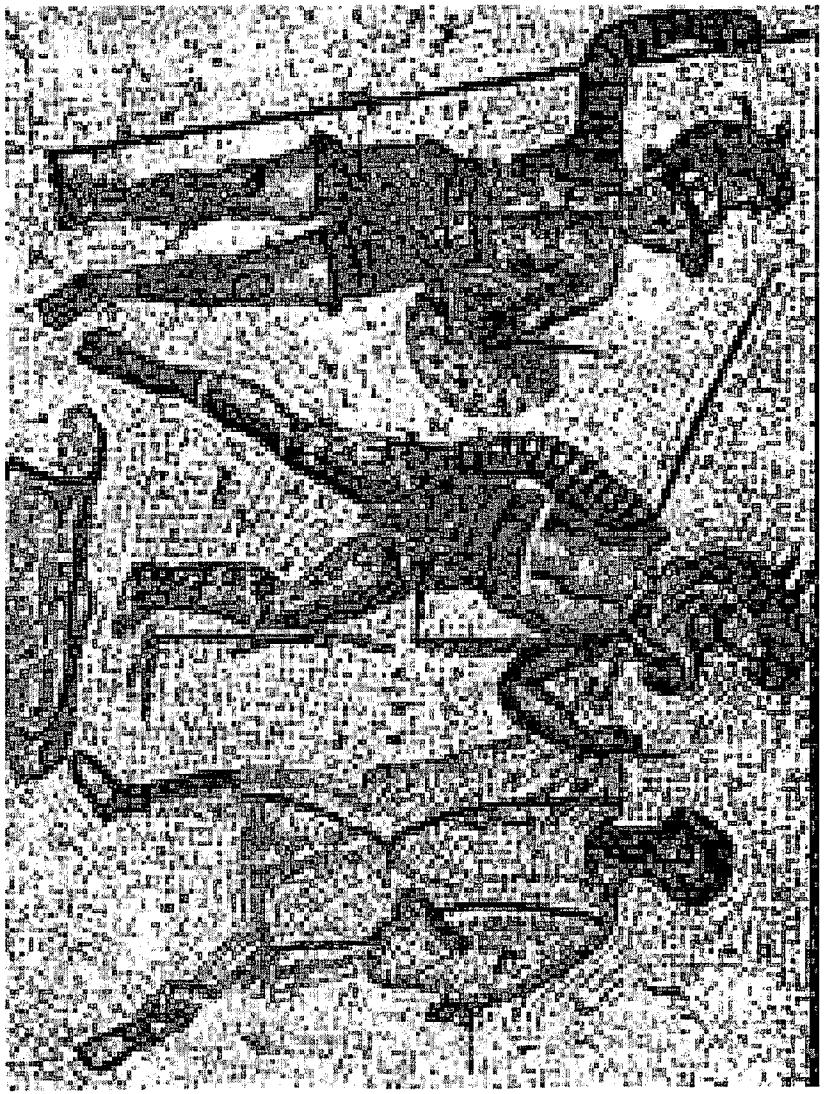
FIG. 1 Prior Art
FIG. 1 is a picture of an ancient tile mosaic depicting an Roman Gladiator wearing an armored protective garment (i.e., manica) on his arm.

In other embodiments, the plurality of rigid armor inserts can be more than two; and, particularly, can be considerably more than two. For example, a large number of relatively small armor tiles (e.g., 2"×2"), can be attached to a flexible substrate and placed inside of the ballistic sleeve. The tiles can be square, rectangular, hexagonal, or circular; and can be butted together or overlapped like fish-scales. By "paving" the surfaces of the arm with a large number of small armor tiles, the flexibility of the garment can be substantially increased. Alternatively, the inserts may be shaped as C-shaped bands that encircle the arm, but are only 1-2 inches wide. They can overlap each other, not unlike the manica design shown in FIG. 1. Alternatively, the armor inserts can be long strips of material, oriented parallel to the long axis of the arm or leg.

The legs of a soldier can be exposed to essentially the same threats from a roadside IED (blast overheat, shock pressure, shrapnel, and spall) as the arms would be. Hence, in all of the embodiments disclosed above, the word "leg" can be substituted for "arm". In this case, the word "garment" could be a set of oversized, armored pant legs or chaps that fit over a soldier's existing pants.

Figure 12:
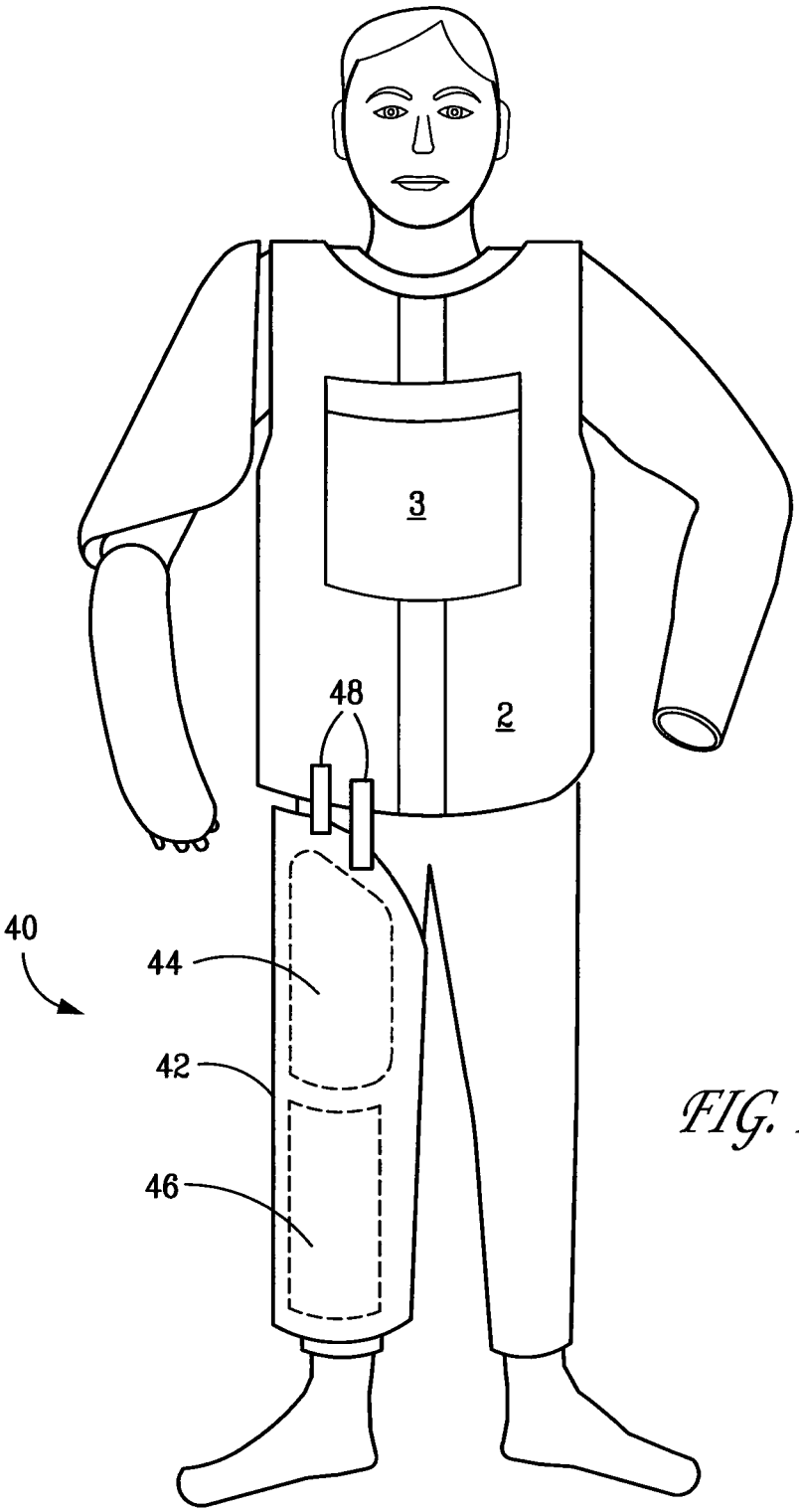
FIG. 12 shows a front, elevation view of a soldier wearing an armored protective leg garment.

FIG. 12 shows a front, elevation view of a soldier wearing an armored protective leg garment 40. Ballistic sleeve 42, which covers the entire length of the leg from ankle to hip in a continuous fashion, is shown in cut-away view for clarity; showing upper leg (thigh) armor insert 44 and lower leg (calf) armor insert 46. Leg garment 40 can be removably attached to body vest 2 with fasteners 48; which allow the leg garment 40 to be rapidly and easily removed in an emergency. The design, construction, and materials are essentially the same as before for the armored protective garment described elsewhere in the application.

Figure 13:
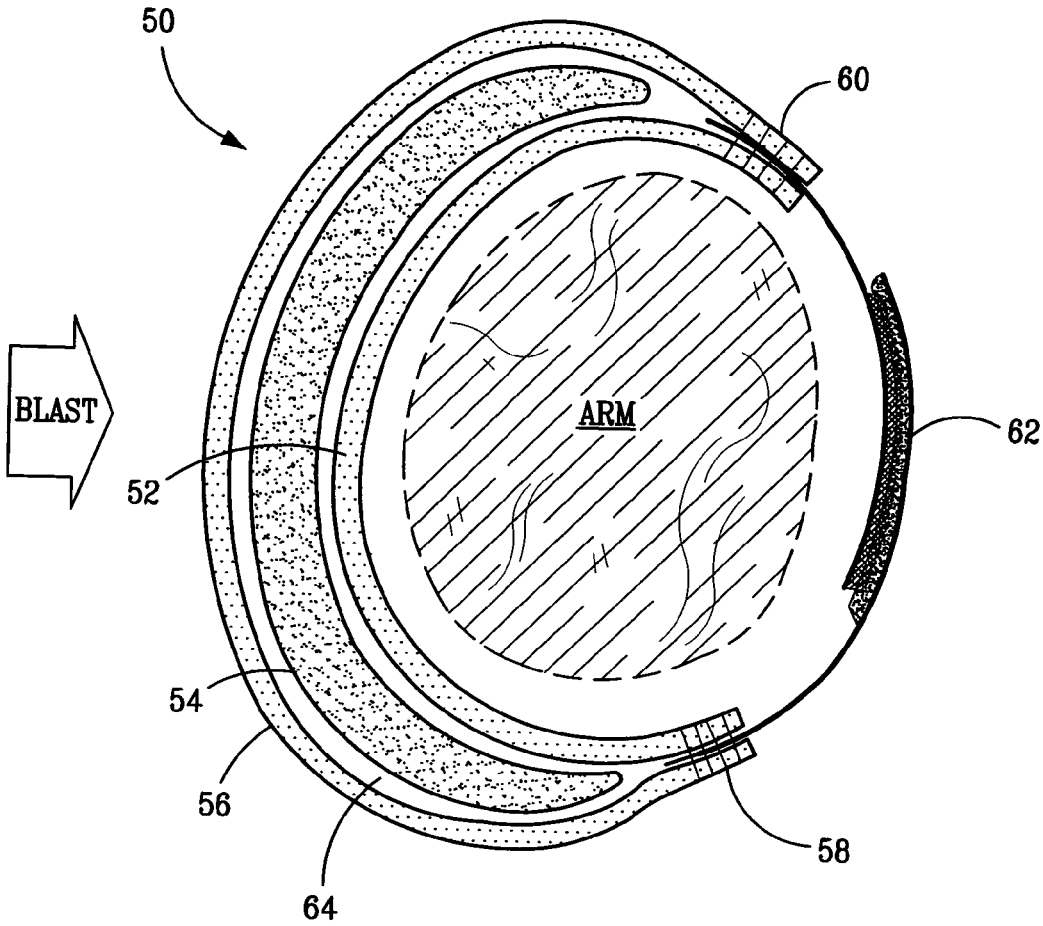
FIG. 13 shows a cross-section end view at Sec. A-A from FIG. 2, of another armored protective garment, according to the present invention.

FIG. 13 shows a cross-section end view at Sec. A-A from FIG. 2, of another armored protective garment, according to the present invention. Garment 50 comprises a C-shaped rigid armor insert 54 sandwiched in-between two layers of ballistic fabric, 52 and 56. In this embodiments however, the ballistic fabric layers do not completely encircle the circumference of the arm (or leg). Rather, they only cover the outer-facing surfaces of the arm facing toward the blast. The two layers of ballistic fabric are sewn together at seams 58 and 60, forming a pocket holding rigid insert 54. The ballistic fabric 52, 56 are continuous along the entire length of the arm (or leg), but the inner facing surfaces of the arm are left exposed. The space defined between inner and outer ballistic fabrics, 52 and 56 forms a pocket 64 for holding the rigid armor insert 54. A hook-and-loop fastener strap 62 (e.g., VELCRO®), secures the garment at discrete locations along the length of the arm (leg). This design allows the garment to be tightly secured to the arm, for a variety of arm diameters and clothing, because of the adjustability of the VELCRO® straps. This embodiment would be less hot and confining as the previous embodiments, and would likely be more flexible. Less protection is afforded to the inner part of the arm, however. A variation of this embodiment is to use a large number of small rigid armor tiles sewn or glued inside of pocket 64. This would provide substantially more flexibility to the garment 50, as compared to using a single lower arm/leg insert and a single upper arm/leg insert.

TEST RESULTS

Some embodiments of an armored protective garment have been tested to better understand its ability to protect a soldier's arms (or legs) from the blast overheated gases, shock pressure, shrapnel, and spall of a RPG or IED.

Proof of concept tests were initially conducted on prototypes of armored protective garments made of KEVLAR® and carbon/epoxy composite rigid inserts with 18 plies using simulated RPG explosions. A pork leg was placed inside of the garment, to simulate a human arm. An explosion equivalent to the heaviest RPG round was set off within 2 -½ feet of the garment. Although the garment was severely damaged, the pork leg was essentially undamaged.

A second test was conducted where a pair of KEVLAR® garments were placed 42 inches below a steel plate, and a RPG was shot at the plate from a 30 degree angle. One garment was just the KEVLAR® sleeve and did not have any rigid armor inserts, while the other included the carbon/composite inserts. The blast generated molten metal spall from the steel plate, in addition to the overpressure shock, superheated gases, and shrapnel. The KEVLAR® sleeve alone withstood the blast superheat and overpressure, but was penetrated by spall and shrapnel. The pork bone was broken and there was some damage to the tissues. The "full" garment, with the carbon/composite inserts, withstood the super heat, blast, spall and shrapnel; with the pork bone suffering only minimal tissue damage and no breaks in the bone.

Next, an extensive series of about 30 tests were performed in a controlled experimental setup to determine the $V_{50}$ ballistic limit of the full garment against different weights of lightweight fragments (simulated as right circular cylinders). The $V_{50}$ velocity is the velocity at which 50% of the fragments will penetrate a target, with the other 50% being stopped by the armor. Two different types of carbon/epoxy composite rigid plates were tested, the original 18 ply plate, and a thicker plate with 28 plies. The C/composite plate was placed inside of a KEVLAR® 29 envelope/sleeve; with 2 layers of KEVLAR® in front of the c/composite plate, and 4 layers of KEVLAR® behind the plate. The total areal density of the full garment with the 18 ply plate was 42 oz/ft$^2$; and the total areal density of the garment with the 28 ply plate was 60.5 oz/ft$^2$.

Testing was carried out according to *Military Specifications* MIL-C44050 and MIL-STD-662F. Testing was performed using a range of standard lightweight fragments in accordance with the above specifications. The results are compared to the minimum performance criteria for the US Army Interceptor body armor. Computer code analysis was implemented to extend the results to include a larger range of fragments and fragment configurations.

Table 1 summarizes the $V_{50}$ test results for the 18 ply c/composite laminate, and Table 2 shows the results for the 28 ply plate.

TABLE 1

Garment $V_{50}$ results with 18 ply C/composite insert

| Projectile | Interceptor $V_{50}$ (ft/s) Minimum Criteria | Garment $V_{50}$ (ft/s) |
|---|---|---|
| 2 gr | 2675 | 3567 |
| 4 gr | 2360 | 2824 |
| 16 gr | 2000 | 2205 |
| 64 gr | 1600 | 1324 |

TABLE 2

Garment $V_{50}$ results with 28 ply C/composite insert

| Projectile | Interceptor $V_{50}$ (ft/s) Minimum Criteria | KEVLAR ® 29/ Carbon Composite $V_{50}$ (ft/s) | KEVLAR ® KM2/ Carbon Composite $V_{50}$ (ft/s) |
|---|---|---|---|
| 2 gr | 2675 | >>3567 | >>4157 |
| 4 gr | 2360 | >>2824 | 3974 |
| 16 gr | 2000 | >>2205 | 3062 |
| 64 gr | 1600 | 1802 | 2026 |

These test results indicate that the armored protective garment, especially using the thicker c/composite plate (i.e., 28 plies), meets or exceeds the same DIG level -III-A standard as that for the US Army Interceptor OTV body armor, with respect to protection against light, high-velocity fragments.

The particular examples discussed above are cited to illustrate particular embodiments of the invention. Other applications and embodiments of the apparatus and method of the present invention will become evident to those skilled in the art. It is to be understood that the invention is not limited in its application to the details of construction, materials used, and the arrangements of components set forth In the following description or illustrated in the drawings.

For example, in the examples that use a pair of rigid armor inserts, the upper insert doesn't have to be the same thicknesses, or even made of the same armor material, as the lower insert. Also, the upper portion of the ballistic sleeve (or pant leg sleeve), can be made of a different number of KEVLAR® layers or a different type of ballistic cloth, as the lower portion. Depending on the level of threat, then, the upper and lower arm/leg segments can have different levels of protection, while still utilizing a continuous article of clothing (garment) along the length of the arm or leg.

The scope of the invention is defined by the claims appended hereto.

What is claimed is:

1. An armored protective garment for protecting an arm or leg, comprising:

a ballistic sleeve sized to completely cover the entire length of the arm or leg; the sleeve comprising a flexible tube made of 6 layers of a ballistic fabric; and a pair of "C"-shaped rigid armor inserts disposed inside of the sleeve, comprising an upper rigid insert that covers the outside-facing surface of the upper arm or leg, and a lower rigid insert that covers the outside-facing surface of the lower arm or leg;

wherein the ballistic sleeve comprises a sewn-in upper pocket that holds the upper rigid insert, and a sewn-in lower pocket that holds the lower rigid insert; and wherein 2 of the 6 layers of ballistic fabric are disposed outside of the rigid inserts, and 4 of the 6 layers of ballistic fabric are disposed inside of the rigid inserts; and wherein the ballistic fabric comprises aramid fibers; and the rigid armor inserts comprise a carbon/epoxy composite laminate material.

2. The armored garment of claim 1, wherein the proximal end of the ballistic sleeve at a shoulder has a configuration that closely matches an armhole of a body armor vest, so as to minimize any exposed gap in-between the sleeve and the vest.

3. The armored garment of claim 1, further comprising means for removably attaching the proximal end of the ballistic sleeve to a body armor vest, or across the shoulder to another armored gauntlet on the opposite arm or leg.

4. The armored garment of claim 1, wherein the carbon/epoxy composite armor inserts comprise from 15 to 30 plies of a woven carbon fiber cloth.

5. The armored garment of claim 1, where the distal end of the ballistic sleeve stops at a wrist; and the lower arm insert extends beyond the end of the sleeve sufficiently far so as to cover and shield a hand and at least some fingers of the hand.

6. The armored garment of claim 1, where the upper arm insert covers and shields a shoulder joint.

7. The armored garment of claim 1, wherein the ballistic sleeve tapers from a larger diameter at the shoulder or hip down to a smaller diameter at the wrist or ankle.

8. The armored garment of claim 1, wherein the thickness of the rigid armor inserts ranges from about 0.2 to 0.5 inches.

9. The armored garment of claim 3, wherein the pockets are sewn closed, permanently holding the armor inserts in their respective pockets.

10. The armored garment of claim 1, wherein upper and lower rigid inserts overlap at the elbow or knee to provide elbow or knee protection.

11. The armored garment of claim 1, wherein the rigid armor inserts comprise a rigid armor material selected from the group consisting of hardened steel, ceramics, metal-ceramic composites, high-strength titanium or aluminum alloys, solid fused plate of ultra-high strength polyethylene fibers and fiber-composite laminates.

12. The armored garment of claim 1, wherein the ballistic fabric comprises high-strength fibers selected from the group consisting of glass fibers, carbon/graphite fibers, aramid fibers, para-aramid fibers, ultra-high molecular weight polyethylene fibers, and ultra-high strength steel filaments, and combinations thereof.

13. The armored garment of claim 1, wherein the ballistic fabric does not completely enclose the circumference of the arm or leg; and wherein the inner part of the arm or leg is exposed and not covered by the garment; and wherein a plurality of hook-and-loop fasteners straps are disposed periodically along the length of the garment for adjustably securing the garment around the circumference of the arm or leg.

* * * * *